US005292383A

United States Patent [19]

Osawa et al.

[11] Patent Number: 5,292,383

[45] Date of Patent: Mar. 8, 1994

[54] STEEL SHEETS FOR PROCELAIN ENAMELING AND METHOD OF PRODUCING THE SAME

[75] Inventors: Kazunori Osawa; Susumu Satoh; Toshiyuki Kato; Hideo Abe; Keiji Nishimura, all of Chiba, Japan

[73] Assignee: Kawasaki Steel Corporation, Japan

[21] Appl. No.: 808,753

[22] Filed: Dec. 17, 1991

Related U.S. Application Data

[62] Division of Ser. No. 486,960, Mar. 1, 1990, Pat. No. 5,098,491.

[30] Foreign Application Priority Data

Mar. 10, 1989 [JP] Japan ..... 1-56345
Feb. 19, 1990 [JP] Japan ..... 2-31521

[51] Int. Cl.[5] ..... C22C 38/16

[52] U.S. Cl. ..... 148/330; 420/89; 420/93; 148/332

[58] Field of Search ..... 420/89, 127, 93, 121, 420/126, 330; 148/12 C, 332

[56] References Cited

FOREIGN PATENT DOCUMENTS 47-31810 8/1972 Japan ..... 148/332
59-229463 12/1984 Japan ..... 420/121
61-276958 12/1986 Japan .

*Primary Examiner*—R. Dean
*Assistant Examiner*—Sikyin Ip
*Attorney, Agent, or Firm*—Austin R. Miller

[57] ABSTRACT

A steel sheet for porcelain enameling having improved press formability and enameling properties comprises particular amounts of C, Mn, B, Cu, Al, O, N, and P or further Ti and Nb and the balance being Fe and inevitable impurities and is produced by hot rolling a slab of steel having a chemical composition as mentioned above as a starting material, cold rolling the resulting hot rolled sheet at a reduction of not less than 70%, and then subjecting the resulting cold rolled sheet to a continuous annealing at a heating temperature of not lower than 800° C. but not higher than $A_{c3}$ transformation point.

7 Claims, 3 Drawing Sheets

STEEL SHEETS FOR PROCELAIN ENAMELING AND METHOD OF PRODUCING THE SAME

This application is a divisional of application Ser. No. 07/486,960, filed Mar. 1, 1990, U.S. Pat. No. 5,098,491.

BACKGROUND OF THE INVENTION

1. Field of the Invention

This invention relates to steel sheets for porcelain enameling having good press formability and improved enameling properties such as fishscale resistance, enamel adhesion property, resistance to blistering and pinhole defects and the like, and a method of producing the same.

2. Related Art Statement

Since the steel sheets for porcelain enameling are subjected to severer press forming as represented by the formation of drainboards, bathtubs and the like, it is required to have a fairly deep drawability and satisfy enamel adhesion property (particularly adhesion property in direct enameling at once), firing strain resistance, fishscale resistance and resistance to blistering and pinhole defects.

From the old time, decarburization capped steels are mainly used as a steel sheet for porcelain enameling having a good press formability, but continuously cast Ti-added steels become a main current at the present.

As to the Ti-added steel, Japanese Patent Application Publication No. 42-12348, No. 44-18066 and the like disclose that an excellent press formability is obtained when the C content is not more than 0.005 wt% (hereinafter shown by % simply). Furthermore, Japanese Patent Application Publication No. 45-40655 and Japanese Patent laid open No. 53-131919, No. 56-9357 and the like disclose that such a Ti-added steel also possesses an excellent fishscale resistance.

In the Ti-added steel, Ti is an element forming carbide, nitride or sulfide and is utilized as a precipitate thereof to trap hydrogen in steel causing the fishscale, resulting in the improvement of the fishscale resistance.

However, Japanese Patent laid open No. 61-276958 discloses that the Ti-added steel creates defects due to poor weldability. Further, Japanese Patent laid open No. 60-110845 discloses that the Ti-added steel is poor in the enamel adhesion property and resistance to blistering and pinhole defects as compared with the conventional decarburization capped steel.

Particularly, the above Japanese Patent laid open No. 61-276958 discloses that the blistering defect and the shrinkage created due to the poor weldability are attempted to be improved by adding slight amounts of Se and Te to suppress blowhole defects at a weld zone and shrinkage. However, the Ti-added steel has a problem that the blistering and pinhole defects are easily caused at portions other than the weld zones.

In addition to the Ti-added steel, B-added steels are widely known as a steel sheet for porcelain enameling as disclosed in Japanese Patent Application Publication No. 54-3446 and No. 54-39808. In such a B-added steel, the precipitate such as BN and the like formed by the addition of B is utilized to improve the fishscale resistance, and also there is no problem on the weldability.

In these references, however, box annealing is used as an annealing method, so that the resulting steel sheets are unsuitable for applications requiring a severe press forming because the mechanical properties of the steel sheet, particularly $\bar{r}$-value are considerably poor.

For this end, a method of improving the $\bar{r}$-value in the B-added steel is disclosed in Japanese Patent Application Publication No. 63-54049. In this case, the heating rate in the annealing is restricted to a particular range of not more than 150° C./hr. Such a heating rate clearly indicates a box annealing. Such an annealing step not only takes considerably many days and runs up the production cost but also is apt to create temperature unevenness in longitudinal and widthwise directions of coils. Particularly, the temperature unevenness in the annealing largely affects a precipitation form of a precipitate effectively preventing the fishscale or a surface segregation exerting on the enamel adhesion property as well as the quality and enameling properties of the coil, and has a drawback that the poor adhesion and fishscale are apt to be caused in use by enameling makers.

SUMMARY OF THE INVENTION

It is, therefore, an object of the invention to provide steel sheets for porcelain enameling having good press formability and fishscale resistance and improved enameling properties such as resistance to blistering and pinhole defects, enamel adhesion property and the like, and a method of advantageously producing the same.

The inventors have made studies and found that the steel sheets for porcelain enameling having good enameling properties, homogeneous quality of coils over longitudinal and widthwise directions thereof and a press formability equal to or more than that of the conventional decarburization capped steel can be produced even when using the B-added steel which has hardly provided steel sheets having a good press formability in the conventional technique.

According to a first aspect of the invention, there is the provision of a steel sheet for porcelain enameling having improved fishscale resistance and press formability, comprising not more than 0.0025% of C, not more than 0.5% of Mn, 0.007–0.020% of B, 0.01–0.07% of Cu, not more than 0.010% of Al, 0.008–0.020% of O, 0.005–0.020% of N, not more than 0.0020% of P, and the balance being Fe and inevitable impurities.

According to a second aspect of the invention, there is the provision of a steel sheet for porcelain enameling having improved fishscale resistance and press formability, comprising not more than 0.0050% of C, not more than 0.50% of Mn, 0.007–0.020% of B, 0.01–0.07% of Cu, not more than 0.010% of Al, 0.008–0.020% of O, 0.005–0.020% of N, not more than 0.020% of P, at least one of not more than 0.050% of Ti and not more than 0.050% of Nb provided that a total amount of Ti and Nb is 0.001–0.050%, and the balance being Fe and inevitable impurities.

According to a third aspect of the invention, the steel sheet defined in the first or second invention further contains 0.0001–0.100% of Se.

According to a fourth aspect of the invention, there is the provision of a method of producing steel sheets for porcelain enameling having improved fishscale resistance and press formability, which comprises hot rolling a slab of steel having chemical compositions as defined in the first, second or third embodiments as a starting material, cold rolling the resulting hot rolled sheet at a reduction of not less than 70%, and then subjecting the resulting cold rolled sheet to a continuous annealing at a heating temperature of not lower than 800° C. but not higher than th $A_{c3}$ transformation point.

BRIEF DESCRIPTION OF THE DRAWINGS

The invention will be described with reference to the accompanying drawings, wherein.

DESCRIPTION OF THE PREFERRED EMBODIMENTS

In the invention, the chemical composition of the steel sheet is restricted to a particular range and also the continuous annealing of high heating temperature is particularly used, whereby steel sheets for porcelain enameling having good enameling properties and an excellent press formability can be produced.

The experimental results leading to the success of the invention will be described below.

EXPERIMENT 1

Vacuum molten steels having common compositions of Si: 0.01%, Mn: 0.25%, B: 0.013%, Cu: 0.03%, Al: 0.001%, P: 0.01%, 0: 0.0140%, N: 0.008% and S: 0.01% and containing a variable C amount of 5–40 ppm were tapped in a laboratory and bloomed to obtain sheet bars of 30 mm in thickness. Then, the sheet bars were soaked in a heating furnace at 1200° C. for 3 hours and hot rolled to a sheet thickness of 4.0 mm at 3 passes. The finish temperature in the hot rolling was 870° C. Thereafter, the hot rolled sheets were cooled in air up to room temperature (average cooling rate: about 3° C./min).

The hot rolled sheets were pickled and cold rolled to obtain a cold rolled sheets of 0.8 mm in thickness (cold rolling reduction: 80%). Then, the cold rolled sheets were degreased and subjected to recrystallization annealing at a heat cycle of heating at a heating rate of 10° C./sec → soaking at a temperature of 830° C. for 5 seconds → cooling at a cooling rate of 15° C./sec.

Then, the $\bar{r}$-value was measured with respect to the thus obtained steel sheets. The $\bar{r}$-value was evaluated by $\bar{r}=(r_{0°}+2xr_{45°}+r_{90°})/4$ after r-values (Lankford value) in directions of 0°, 45° and 90° with respect to the rolling direction were measured to a tensile test specimen of JIS No. 5. The results are shown in FIG. 1.

Figure 1:
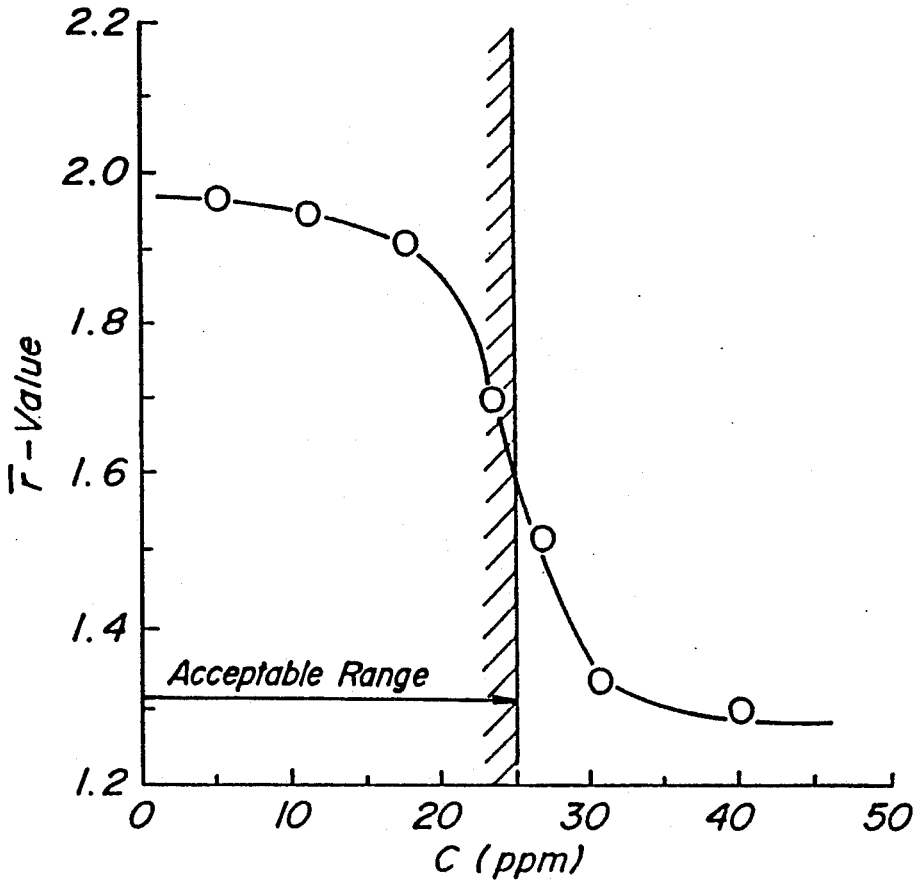
FIG. 1 is a graph showing the an influence of the C amount upon $\bar{r}$-value.

As seen from FIG. 1, when the C amount is not more than 25 ppm, good $\bar{r}$-value can be obtained even in the B-added steel being anxious about a bad influence upon the drawability without adding a carbide forming element such as Ti, Nb or the like.

The examination on an influence of annealing temperature upon the $\bar{r}$-value will be described below.

EXPERIMENT 2

There were provided steels (steel A to steel H) having chemical compositions as shown in the following Table 1. The steels G and H were Ti-added steel containing no B and decarburization capped steel containing no B as a comparative example.

TABLE 1

| | Chemical compositions (wt %) | | | | | | | | | | | | | |
|---|---|---|---|---|---|---|---|---|---|---|---|---|---|---|
| Steel | C | Si | Mn | B | Cu | Al | P | O | N | S | Ti | Nb | Se | Remarks |
| A | 0.0009 | 0.011 | 0.13 | 0.0120 | 0.034 | 0.001 | 0.009 | 0.0138 | 0.0095 | 0.005 | — | — | — | ◎ |
| B | 0.0030 | 0.010 | 0.27 | 0.0127 | 0.029 | 0.002 | 0.010 | 0.0101 | 0.0069 | 0.009 | — | — | — | ★ |
| C | 0.0027 | 0.013 | 0.08 | 0.0103 | 0.031 | 0.001 | 0.007 | 0.0129 | 0.0073 | 0.017 | 0.016 | — | — | ◎ |
| D | 0.0017 | 0.007 | 0.18 | 0.0121 | 0.027 | 0.001 | 0.009 | 0.0153 | 0.0079 | 0.016 | 0.022 | 0.007 | — | ◎ |
| E | 0.0019 | 0.008 | 0.22 | 0.0100 | 0.029 | 0.001 | 0.005 | 0.0161 | 0.0090 | 0.008 | — | 0.023 | — | ◎ |
| F | 0.0018 | 0.010 | 0.25 | 0.0103 | 0.032 | 0.001 | 0.006 | 0.0158 | 0.0085 | 0.010 | — | 0.025 | 0.010 | ◎ |
| G | 0.0026 | 0.007 | 0.24 | — | 0.035 | 0.048 | 0.017 | 0.0031 | 0.0074 | 0.026 | 0.102 | — | — | ★ |
| H | 0.0016 | 0.002 | 0.17 | — | 0.023 | 0.001 | 0.007 | 0.0497 | 0.0024 | 0.004 | — | — | — | ★ |

underlined portion: outside range of the invention
◎: Invention steel
★: Comparative steel Each of these steels was tapped in a laboratory and bloomed to obtain a sheet bar of 30 mm in thickness. Then, the sheet bars were soaked in a heating furnace at 1250° C. for 4 hours and hot rolled to a sheet thickness of 4.0 mm at 3 passes. The finish temperature in the hot rolling was 870° C. Thereafter, the hot rolled sheets were cooled in air to room temperature (cooling rate: about 3° C./min).

The hot rolled sheets were pickled and cold rolled to obtain cold rolled sheets of 0.8 mm in thickness (cold rolling reduction: about 80%). Then, the cold rolled sheets were degreased and subjected to recrystallization annealing in a heat cycle of heating at a heating rate of about 10° C./sec → soaking at 720°–930° C. for 4 seconds → cooling at a cooling rate of about 10° C./sec.

The $\bar{r}$-value was measured with respect to the annealing steel sheets. The results are shown in FIG. 2.

Figure 2:
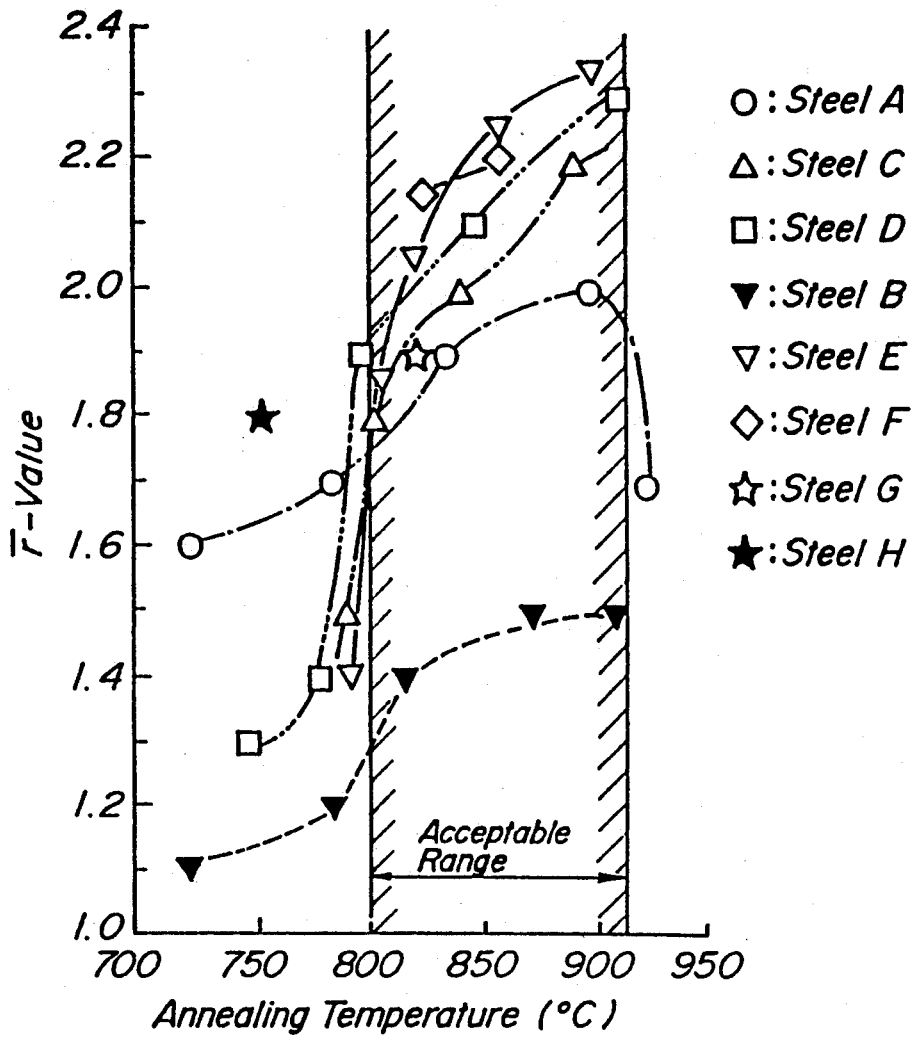
FIG. 2 is a graph showing the influence of an annealing temperature upon $\bar{r}$-value in B-added steels having various compositions and produced under various conditions and the conventional Ti-added steel and decarburization capped steel.

As seen from FIG. 2, the $\bar{r}$-value is improved in the steels according to the invention when the annealing temperature is not lower than 800° C.

Furthermore, the $\bar{r}$-value tends to increase as the cold rolling reduction becomes high. However, in case of the conventional steel B (C>0.0025), the improvement of $\bar{r}$-value is not caused even when the annealing temperature is raised.

Moreover, each steel sheet after the annealing was subjected to a pretreatment for enameling [pickling time: 20 minutes, Ni immersion time: 20 minutes (Ni adhered amount: 20 mg/dm$^2$)], a direct enamel glazing at once and a firing at 820° C. for 3 minutes according to steps shown in the following Table 2.

TABLE 2

| | Step | Contents |
|---|---|---|
| 1 | degreasing | alkali degreasing |
| 2 | hot washing | |
| 3 | washing with water | |
| 4 | pickling | immersion in 10% $H_2SO_4$ at 75° C. |
| 5 | washing with water | |
| 6 | Ni flash | immersion in 2% $NiSO_4$ at 65° C. |

TABLE 2-continued

| | Step | Contents |
|---|---|---|
| 7 | washing with water | |
| 8 | neutralization | immersion in 2% $Na_2CO_3$ at 65° C. for 5 minutes |
| 9 | drying | |
| 10 | glazing | direct glazing at once |
| 11 | drying | 160° C., 10 minutes |
| 12 | firing | 820° C., 3 minutes |

Thereafter, the tendency of generating the blistering and pinhole defects (absence or small, middle, large) was visually measured with respect to the test steel sheet, in which the absence or small was evaluated as good. Further, the enamel adhesion property was measured by PEI adhesion test (adhesion test method (ASTM C313-59) recommended by The Porcelain Enamel Institute of USA). The results are shown in the following Table 3.

Moreover, the degree of generating blowhole defects and the shrinkage was visually observed as a weldability, and evaluated as mark ◎: no occurrence, mark ○: slight occurrence and mark x: many occurrence in Table 3.

TABLE 3

| Steel | Firing temperature (°C.) | Blistering and pinhole defects | PEI adhesion property (%) | Weldability | Remarks |
|---|---|---|---|---|---|
| A | 830 | none | 100 | ○ | ◎ |
| B | 870 | none | 95 | ○ | ★ |
| C | 840 | none | 100 | ○ | ◎ |
| D | 850 | none | 100 | ○ | ◎ |
| E | 860 | none | 100 | ○ | ◎ |
| F | 860 | none | 100 | ◎ | ◎ |
| G | 820 | presence | 90 | x | ★ |
| H | 750 | none | 100 | ◎ | ★ |

underlined portion: outside range of the invention
◎: Invention steel
★: Comparative steel In the steel G, the blistering and pinhole defects were generated and also the shrinkage was created in the weld zone. In the steels other than the steel G, the PEI adhesion property and the resistance to blistering and pinhole defects were good. Furthermore, the steel F containing Se was good in the weldability as compared with the other steels (excluding the steel H).

EXPERIMENT 3

The influence of cold rolling reduction upon $\bar{r}$-value was examined below. Sheet bars of 30 mm in thickness having the same chemical composition of steels A to H as in Experiment 2 were soaked in a heating furnace at 1250° C. for 4 hours and hot rolled to a thickness of 2-6 mm at 3 passes. The finish temperature in the hot rolling was 870° C. Thereafter, the sheets were cooled in air.

The hot rolled sheets were pickled and cold rolled to obtain a cold rolled sheets of 0.7 mm in thickness (cold rolling reduction: about 65-88%). Then, the cold rolled sheets were degreased and subjected to re-crystallization annealing in a heat cycle of heating at a heating rate of about 15° C./sec → soaking at a temperature of 860° C. for 1 second → cooling at a cooling rate of about 15° C./sec.

The $\bar{r}$-value was measured with respect to the thus obtained steel sheets. The results are shown in FIG. 3.

Figure 3:
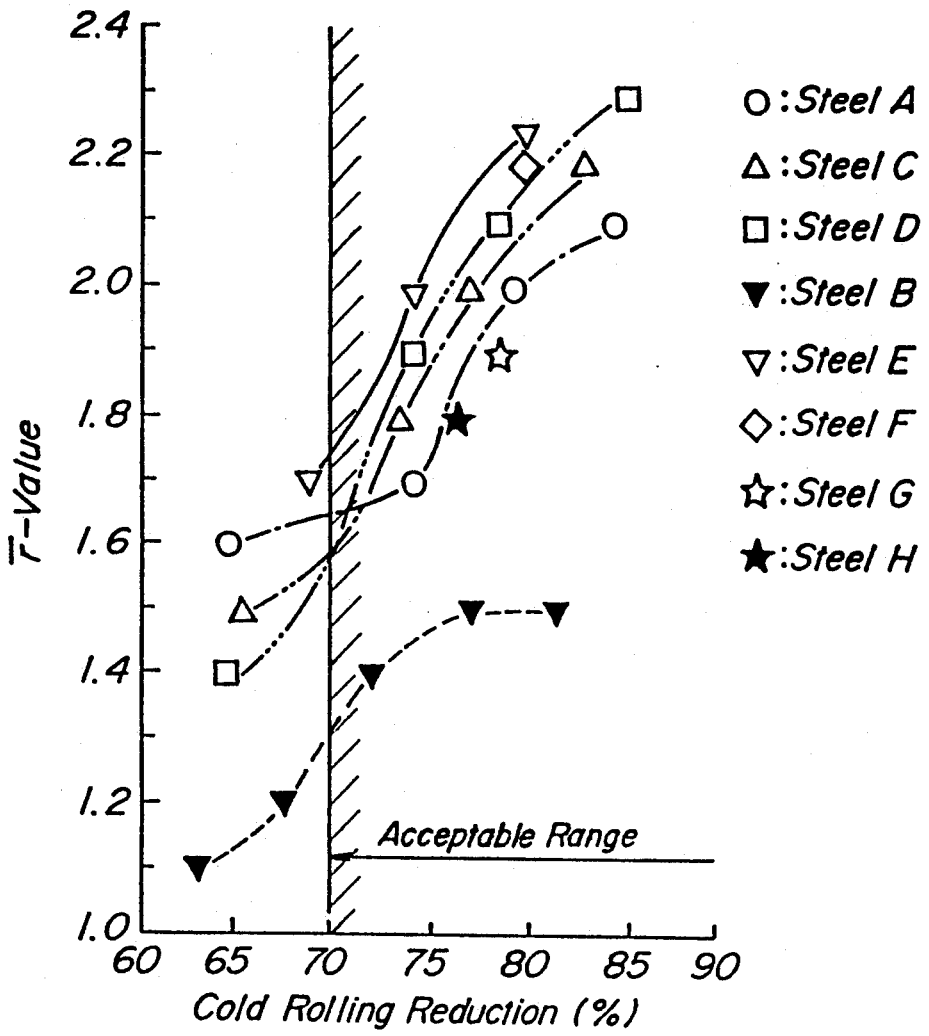
FIG. 3 is a graph showing the influence of a cold rolling reduction upon $\bar{r}$-value in B-added steels having various compositions and produced under various conditions and the conventional Ti-added steel and decarburization capped steel.

As seen from FIG. 3, the $\bar{r}$-value tends to increase when the cold rolling reduction is not less than 70% and is equal to or more than those of the Ti-added steel and decarburization capped steel.

The reason why the above results are obtained is considered to be due to the facts that the C amount is restricted to not more than 25 ppm as a steel composition, the cold rolling reduction is raised and the continuous annealing temperature is high as a production condition and the recrystallization texture, particularly (111) texture is developed by the synergistic effect of the above composition and conditions using BN as a nucleus.

The reason on the limitations of steel compositions and production conditions according to the invention will be described below.

C: C is an interstitial solute element. When the amount exceeds 0.0025%, the steel becomes considerably hard and also blistering and pinhole defects are caused by $CO_2$ gas generated to considerably degrade the enameling appearance. Therefore, when a carbide and nitride forming element such as Ti, Nb or the like is not added, it is necessary to reduce solid solute C as far as possible. To this end, in the first embodiment invention adding no Ti and Nb, the upper limit of the C amount is 0.0025%. In the second invention adding Ti and Nb, the solid solute C is precipitated as TiC and NbC, so that the degradation of the mechanical properties is not caused even when the C amount is large. However, when the C amount exceeds 0.0050%, the precipitates of TiC and NbC become fine and degrade the mechanical properties, so that the C amount exceeding 0.005% is not favorable even when Ti and Nb are added. Therefore, in the second invention adding Ti and Nb, the upper limit of the C amount is 0.0050%.

Mn: Mn is an effective element for fixing S, which causes the red shortness in the hot rolling, as MnS and forming the unevenness on the steel sheet surface in the pickling at the pretreatment step for enameling so as to improve the enamel adhesion property. Therefore, the Mn amount is desirable to be not less than about 0.05%. However, when the Mn amount exceeds 0.50%, the steel becomes hard and degrades the ductility and press formability. In the invention, therefore, the upper limit of the Mn amount is 0.50%.

B: B is an element added for improving the fishscale resistance. When the B amount is less than 0.007%, the precipitates such as BN, $B_2O_3$ and the like for preventing the fishscale are decreased, so that the lower limit is 0.007%. Further, when the amount exceeds 0.020%, the degradation of the properties becomes conspicuous under an influence of solid solute B, so that the upper limit is 0.020%.

Cu: Cu is an effective element for controlling the pickling rate in the pickling at the pretreatment step for enameling. Particularly, the B-added steel as in the invention is important to contain Cu because the pickling rate is 2-3 times higher than that of the conventional decarburization capped steel. In this case, the Cu amount is necessary to be at least 0.01% for bringing out the addition effect. However, when the Cu amount exceeds 0.07%, the pickling rate becomes too late and the enamel adhesion property at a short pickling time is degraded. Therefore, the Cu amount in the invention is 0.01-0.07%.

Al: Al is usually used as a deoxidizing agent at a steel-making stage and is an effective element for controlling 0 amount in the invention. When the Al amount exceeds 0.010%, the amount of oxide effective for preventing the fishscale reduces, so that the upper limit of the Al amount is 0.010% in the invention.

O: In the invention, O is an element effective for improving the fishscale resistance together with B and N. In order to bring out the addition effect, the O amount is necessary to be at least 0.008%. However, when the amount exceeds 0.020%, blowhole as a cause of surface defects is apt to be caused in the continuous casting, so that the upper limit is 0.020%.

N: In general, N is an interstitial atom in steel which degrades the mechanical properties likewise C. In the invention, N is precipitated and fixed as BN owing to the B-added steel, so that there is particularly no problem in the mechanical properties. Furthermore, such a precipitate forms a trap site for hydrogen causing the fishscale defect, so that the N amount is favorable to become large. In this connection, the N amount is necessary to be not less than 0.005% for completely preventing the fishscale. However, when the N amount exceeds 0.020%, the amount of B added should be increased and a risk of degrading the mechanical properties becomes large, so that the N amount in the invention is within a range of 0 005–0.020%.

P: When the P amount exceeds 0.020%, not only does the steel become hard to degrade the press formability but also the pickling rate at the pretreatment for enameling is raised and increases scabs which cause the blistering and pinhole defects, so that the upper limit of the P amount in the invention is 0.020%.

Ti and Nb: In the second embodiment of the invention, at least one of not more than 0.050% of Ti and not more than 0.050% of Nb (0.001–0.050% in total in case of two elements added) is added. The addition of these elements is to precipitate C, which degrades the mechanical properties of the steel sheet and the enameling appearance at solid solution state, as TiC or NbC. In order to develop this effect, it is preferable to add each of these elements in an amount of at least 0.001%. However, when the amount exceeds 0.050% alone or in total, the recrystallization temperature in the continuous annealing is considerably raised, so that the upper limit is 0.050%.

Se: Se is an element effective for improving the weldability and the enameling appearance (resistance to blistering and pinhole defects), and has particularly an effect for lessening the viscosity of molten steel to improve the shrinkage at a weld zone and the like and suppressing the occurrence of scabs adhered to the steel sheet surface at the pickling with sulfuric acid in the pretreatment step for enameling, so that not less than 0.0001% of Se is added in the third invention. However, when the Se amount exceeds 0.100%, the enamel adhesion property is degraded, so that the upper limit is 0.100%.

Moreover, the inevitable impurities badly affect the mechanical properties and the enameling property, so that it is preferable to reduce these impurities as far as possible. That is, it is desirable that Si is not more than 0.03% and S is not more than 0.03%.

The slab of steel according to the invention can be produced by a blooming method or a continuous casting method.

In the invention, the heating temperature of the slab is not particularly restricted. As far as the chemical compositions of steel is within the range defined in the invention, even when the heating is carried out at the usual temperature of 1250° C., if the subsequent steps satisfy the cold rolling reduction and the production conditions defined in the invention, it is possible to obtain a good drawability. Moreover, in order to obtain a higher $\bar{r}$-value, it is sufficient that the heating is carried out at a temperature of not higher than 1200° C. (e.g. 1050° C.) and the soaking time is made shorter.

Hot rolling conditions: In the invention, the hot rolling conditions are not particularly restricted. The enameling properties are not so influenced when the hot rolling is finished at a temperature of not less than usual $A_{r3}$ transformation point or when the finishing is carried out at a low temperature of not more than $A_{r3}$ transformation point. However, if it is intended to seriously take the mechanical properties of the steel sheet, the finish temperature in the hot rolling is desirable to be not less than $A_{r3}$ transformation point. Further, the coiling temperature is favorable to be high, particularly not lower than 500° C. if it is intended to ensure the good mechanical properties.

Cold rolling conditions: In the fourth embodiments of the invention, the reduction in the cold rolling is not less than 70%. When the cold rolling reduction is less than 70%, it is difficult to produce a cold rolled steel sheet having a good drawability ($\bar{r}$-value) and a small plane anisotropy. In this invention, the upper limit of the cold rolling reduction is not particularly restricted, but it is desirable to be 95% because when the reduction exceeds 95%, the plane anisotropy becomes large.

Continuous annealing conditions: In the fourth embodiment invention, the continuous annealing method is adopted as a recrystallization annealing because the annealing step can be completed in a short time and also the surface segregation and grain boundary segregation of components in steel badly exerting on the enameling properties can be controlled to make the properties in the coil uniform. Furthermore, the annealing temperature is within a range of not lower than 800° C. to not more than $A_{c3}$ transformation point (approximately 900° C. to 950° C.). When the annealing temperature is lower than 800° C., the $\bar{r}$-value is not improved and also the cracking is caused during the pressing, while when the annealing temperature exceeds $A_{c3}$ transformation point, the recrystallization texture is randomized and the drawability ($\bar{r}$-value) decreases.

Moreover, steel sheets having a high $\bar{r}$-value can be obtained even when the steels according to the first to third embodiment of the invention are subjected to a box annealing in addition to the continuous annealing. In this case, 650-$A_{c3}$ and 1 hour to 1 week are favorable as the annealing conditions. Because, the C amount is reduced to not more than 25 ppm in the first invention, and the carbide and nitride forming element such as Ti and Nb is included in the second invention, and Se not badly exerting on the properties is added in the third invention.

The steel sheets having the chemical composition and produced under the production conditions as mentioned above have a press formability equal to or more than that of the conventional decarburization capped steel even in the case of using the continuous casting method and hardly create the blistering and pinhole defects even when being subjected to a direct enameling at once, so that steel sheets suitable for porcelain enameling can be produced therefrom. Furthermore, the enameling properties are unchangeable even in applications other than the direct glazed enamel.

The following examples are given in illustration of the invention and are not intended as limitations thereof.

There were provided continuously cast slabs each having a chemical composition as shown in the following Table 4. (Only steel 18 shows a chemical composition after the cold rolling and annealing because a rimmed steel was decarburized and denitrided in an open coil annealing furnace.)

TABLE 4(a)

| Steel | Chemical compositions (wt %) | | | | | | | | | | | | |
|---|---|---|---|---|---|---|---|---|---|---|---|---|---|
| | C | Si | Mn | B | Cu | Al | P | O | N | S | Ti | Nb | Se |
| 1 | 0.0009 | 0.012 | 0.15 | 0.0120 | 0.031 | 0.001 | 0.008 | 0.0146 | 0.0082 | 0.007 | — | — | — |
| 2 | 0.0005 | 0.007 | 0.05 | 0.0070 | 0.029 | 0.003 | 0.006 | 0.0152 | 0.0068 | 0.002 | — | — | — |
| 3 | 0.0012 | 0.010 | 0.26 | 0.0135 | 0.034 | 0.002 | 0.013 | 0.0161 | 0.0067 | 0.011 | 0.012 | — | — |
| 4 | 0.0025 | 0.006 | 0.35 | 0.0142 | 0.022 | 0.001 | 0.006 | 0.0148 | 0.0072 | 0.008 | 0.035 | — | — |
| 5 | 0.0061 | 0.009 | 0.21 | 0.0121 | 0.030 | 0.002 | 0.010 | 0.0161 | 0.0084 | 0.011 | 0.015 | — | — |
| 6 | 0.0037 | 0.011 | 0.20 | 0.0112 | 0.030 | 0.001 | 0.017 | 0.0132 | 0.0092 | 0.004 | 0.045 | 0.008 | — |
| 7 | 0.0014 | 0.006 | 0.13 | 0.0108 | 0.025 | 0.002 | 0.004 | 0.0127 | 0.0068 | 0.008 | — | 0.009 | — |
| 8 | 0.0035 | 0.011 | 0.24 | 0.0142 | 0.034 | 0.002 | 0.009 | 0.0176 | 0.0084 | 0.014 | — | — | — |
| 9 | 0.0010 | 0.008 | 0.34 | 0.0108 | 0.022 | 0.001 | 0.011 | 0.0082 | 0.0103 | 0.009 | 0.007 | 0.015 | — |
| 10 | 0.0015 | 0.014 | 0.05 | 0.0116 | 0.035 | 0.001 | 0.006 | 0.0100 | 0.0077 | 0.004 | — | 0.035 | — |
| 11 | 0.0057 | 0.003 | 0.18 | 0.0136 | 0.026 | 0.001 | 0.008 | 0.0191 | 0.0072 | 0.006 | — | 0.040 | — |
| 12 | 0.0015 | 0.015 | 0.27 | 0.0094 | 0.045 | 0.001 | 0.024 | 0.0124 | 0.0072 | 0.008 | — | — | — |
| 13 | 0.0012 | 0.007 | 0.14 | 0.0126 | 0.036 | 0.014 | 0.007 | 0.0035 | 0.0045 | 0.009 | — | — | — |
| 14 | 0.0019 | 0.006 | 0.22 | 0.0035 | 0.022 | 0.002 | 0.009 | 0.0092 | 0.0068 | 0.007 | — | — | — |
| 15 | 0.0012 | 0.008 | 0.25 | 0.0127 | 0.006 | 0.001 | 0.015 | 0.0084 | 0.0041 | 0.023 | — | — | — |
| 16 | 0.0010 | 0.012 | 0.26 | 0.0127 | 0.032 | 0.037 | 0.014 | 0.0039 | 0.0075 | 0.014 | — | — | — |
| 17 | 0.0016 | 0.007 | 0.57 | 0.0106 | 0.026 | 0.001 | 0.012 | 0.0174 | 0.0083 | 0.016 | — | — | — |
| 18 | 0.0012 | 0.009 | 0.22 | — | 0.031 | 0.001 | 0.008 | 0.0502 | 0.0015 | 0.009 | — | — | — |
| 19 | 0.0038 | 0.008 | 0.25 | 0.0098 | 0.033 | 0.002 | 0.009 | 0.0091 | 0.0068 | 0.008 | — | — | — |

underlined portion: outside range of the invention

TABLE 4 (b)

| Steel | Chemical compositions (wt %) | | | | | | | | | | | | |
|---|---|---|---|---|---|---|---|---|---|---|---|---|---|
| | C | Si | Mn | B | Cu | Al | P | O | N | S | Ti | Nb | Se |
| 20 | 0.0012 | 0.004 | 0.18 | 0.0133 | 0.029 | 0.001 | 0.007 | 0.0142 | 0.0072 | 0.009 | — | — | — |
| 21 | 0.0020 | 0.010 | 0.31 | 0.0101 | 0.022 | 0.001 | 0.010 | 0.0184 | 0.0081 | 0.012 | — | 0.019 | — |
| 22 | 0.0014 | 0.008 | 0.19 | 0.0138 | 0.070 | 0.001 | 0.009 | 0.0140 | 0.0078 | 0.009 | — | 0.025 | — |
| 23 | 0.0021 | 0.003 | 0.22 | 0.0143 | 0.084 | 0.002 | 0.009 | 0.0153 | 0.0076 | 0.010 | — | 0.021 | — |
| 24 | 0.0061 | 0.009 | 0.21 | 0.0121 | 0.030 | 0.002 | 0.010 | 0.0161 | 0.0084 | 0.011 | 0.015 | — | — |
| 25 | 0.0023 | 0.008 | 0.48 | 0.0130 | 0.026 | 0.001 | 0.011 | 0.0154 | 0.0092 | 0.009 | — | — | 0.030 |
| 26 | 0.0018 | 0.007 | 0.05 | 0.0113 | 0.031 | 0.002 | 0.014 | 0.0130 | 0.0068 | 0.005 | — | — | — |
| 27 | 0.0017 | 0.010 | 0.24 | 0.0191 | 0.019 | 0.001 | 0.009 | 0.0123 | 0.0073 | 0.012 | — | — | — |
| 28 | 0.0028 | 0.009 | 0.21 | 0.0133 | 0.065 | 0.001 | 0.010 | 0.0145 | 0.0086 | 0.008 | 0.031 | — | 0.007 |
| 29 | 0.0013 | 0.008 | 0.20 | 0.0108 | 0.035 | 0.008 | 0.012 | 0.0081 | 0.0091 | 0.009 | — | — | — |
| 30 | 0.0024 | 0.006 | 0.32 | 0.0189 | 0.043 | 0.006 | 0.006 | 0.0092 | 0.0178 | 0.012 | — | 0.018 | — |
| 31 | 0.0035 | 0.009 | 0.28 | 0.0130 | 0.037 | 0.001 | 0.013 | 0.0150 | 0.0051 | 0.008 | 0.022 | 0.014 | 0.015 |
| 32 | 0.0017 | 0.013 | 0.25 | 0.0113 | 0.026 | 0.001 | 0.014 | 0.0199 | 0.0080 | 0.009 | — | 0.036 | — |
| 33 | 0.0030 | 0.008 | 0.10 | 0.0120 | 0.052 | 0.002 | 0.010 | 0.0103 | 0.0064 | 0.011 | 0.047 | — | — |
| 34 | 0.0026 | 0.010 | 0.18 | 0.0100 | 0.037 | 0.001 | 0.009 | 0.0092 | 0.0089 | 0.006 | — | 0.050 | — |
| 35 | 0.0041 | 0.006 | 0.07 | 0.0072 | 0.030 | 0.001 | 0.004 | 0.0185 | 0.0068 | 0.009 | 0.028 | 0.020 | — |
| 36 | 0.0023 | 0.010 | 0.31 | 0.0098 | 0.024 | 0.002 | 0.008 | 0.0140 | 0.0080 | 0.008 | — | 0.012 | 0.094 |
| 37 | 0.0017 | 0.012 | 0.29 | 0.0106 | 0.026 | 0.001 | 0.005 | 0.0177 | 0.0100 | 0.013 | — | 0.010 | 0.0003 |
| 38 | 0.0019 | 0.008 | 0.30 | 0.0097 | 0.041 | 0.043 | 0.015 | 0.0051 | 0.0073 | 0.005 | — | — | — |

underlined portion: outside range of the invention

Each of these continuously cast slabs was treated under hot rolling conditions, cold rolling reduction, annealing conditions and skin-pass rolling reduction as shown in the following Table 5. That is, the slab was heated at a slab reheating temperature (S.R.T.) of 1000°-1250° C., rough rolled at 3 passes, hot rolled in a finish rolling mill of 6 stands to a thickness of 2.4-5.5 mm at a finish delivery temperature (F.D.T.) of 830°-900° C. and then coiled at a coiling temperature (C.T.) of 520°-700° C. to obtain a hot rolled coil. This coil was pickled and cold rolled in a cold rolling mill of 4 stands to obtain a cold rolled sheet of 0.8 mm in thickness, which was then passed through a continuous annealing line, at where recrystallization annealing was carried out in a heat cycle of heating rate: 10° C./sec, soaking temperature: 760°-900° C., soaking time: 1-120 seconds and cooling rate: 15° C./sec. Moreover, a part of the cold rolled sheets (mark ★ in Table 5) was subjected to a box annealing (heating rate: 30°-100° C./hr, soaking temperature: 680°-720° C.). Then, the sheets were subjected to a skin-pass rolling at a reduction of 0.3-2.0%.

TABLE 5

| Steel | Hot rolling conditions | | | | Cold rolling reduction (%) | Annealing conditions | | Skin-pass rolling reduction (%) | Remarks |
|---|---|---|---|---|---|---|---|---|---|
| | S.R.T. (°C.) | F.D.T (°C.) | C.T (°C.) | sheet thickness (mm) | | Temperature (°C.) | time (s) | | |
| 1 | 1200 | 860 | 550 | 3.5 | 77 | 880 | 5 | 0.8 | — |
| 2 | 1170 | 880 | 530 | 3.9 | 79 | 850 | 1 | 0.5 | — |

TABLE 5-continued

| Steel | Hot rolling conditions S.R.T. (°C.) | F.D.T (°C.) | C.T (°C.) | sheet thickness (mm) | Cold rolling reduction (%) | Annealing conditions Temperature (°C.) | time (s) | Skin-pass rolling reduction (%) | Remarks |
|---|---|---|---|---|---|---|---|---|---|
| 3 | 1210 | 830 | 600 | 4.5 | 82 | 870 | 20 | 0.8 | — |
| 4 | 1205 | 840 | 640 | 5.0 | 84 | 830 | 4 | 1.0 | — |
| 5 | 1250 | 870 | 500 | 2.6 | 69 | 850 | 30 | 1.5 | — |
| 6 | 1050 | 900 | 540 | 3.8 | 79 | 900 | 3 | 2.0 | — |
| 7 | 1000 | 890 | 580 | 5.5 | 85 | 820 | 1 | 1.0 | — |
| 8 | 1190 | 830 | 520 | 4.0 | 80 | 850 | 6 | 0.5 | — |
| 9 | 1130 | 850 | 580 | 3.7 | 78 | 760 | 3 | 0.5 | — |
| 10 | 1230 | 840 | 520 | 2.4 | 67 | 820 | 9 | 1.0 | — |
| 11 | 1130 | 870 | 570 | 3.7 | 78 | 840 | 3 | 0.8 | — |
| 12 | 1150 | 880 | 590 | 4.2 | 81 | 820 | 6 | 1.0 | — |
| 13 | 1200 | 830 | 620 | 4.0 | 80 | 840 | 40 | 0.5 | — |
| 14 | 1100 | 840 | 520 | 5.0 | 84 | 860 | 5 | 1.5 | — |
| 15 | 1190 | 860 | 560 | 3.8 | 79 | 830 | 120 | 0.5 | — |
| 16 | 1230 | 840 | 590 | 4.7 | 83 | 830 | 30 | 1.0 | — |
| 17 | 1270 | 900 | 640 | 3.3 | 76 | 880 | 3 | 0.8 | — |
| 18 | 1200 | 860 | 530 | 3.5 | 78 | 720 | 10 h | 0.8 | ★ |
| 19 | 1230 | 840 | 600 | 3.3 | 76 | 680 | 5 h | 0.8 | ★ |
| 20 | 1230 | 840 | 600 | 3.3 | 76 | 680 | 5 h | 0.8 | ★ |
| 21 | 1230 | 840 | 600 | 3.3 | 76 | 680 | 5 h | 0.8 | ★ |
| 22 | 1100 | 850 | 650 | 4.0 | 80 | 900 | 60 | 0.8 | — |
| 23 | 1050 | 860 | 700 | 3.6 | 78 | 880 | 30 | 0.5 | — |
| 24 | 1200 | 830 | 630 | 4.3 | 81 | 850 | 120 | 0.6 | — |
| 25 | 1100 | 870 | 600 | 4.0 | 80 | 800 | 180 | 0.4 | — |
| 26 | 1250 | 850 | 550 | 3.8 | 79 | 880 | 10 | 1.0 | — |
| 27 | 1200 | 830 | 600 | 3.2 | 75 | 900 | 5 | 0.5 | — |
| 28 | 1200 | 840 | 580 | 4.5 | 82 | 840 | 30 | 0.7 | — |
| 29 | 1140 | 870 | 630 | 4.0 | 80 | 860 | 60 | 0.5 | — |
| 30 | 1100 | 880 | 680 | 3.0 | 73 | 830 | 120 | 0.3 | — |
| 31 | 1250 | 900 | 700 | 2.8 | 71 | 870 | 40 | 0.6 | — |
| 32 | 1070 | 830 | 620 | 3.5 | 77 | 890 | 35 | 0.4 | — |
| 33 | 1100 | 850 | 650 | 5.0 | 84 | 860 | 20 | 0.5 | — |
| 34 | 1250 | 880 | 640 | 4.7 | 83 | 840 | 50 | 0.7 | — |
| 35 | 1170 | 860 | 600 | 3.5 | 77 | 850 | 3 | 0.5 | — |
| 36 | 1200 | 900 | 520 | 3.8 | 79 | 860 | 10 | 0.5 | — |
| 37 | 1060 | 830 | 550 | 4.0 | 80 | 860 | 15 | 0.5 | — |
| 38 | 1200 | 840 | 600 | 3.3 | 76 | 680 | 5 h | 0.8 | ★ |

★ box annealing

Thereafter, these steel sheets were subjected to pretreatment (pickling time: 1–50 minutes, Ni immersion time: 5 minutes), glazing and firing according to the steps shown in Table 2.

The mechanical properties and the enameling properties of these sheets were measured to obtain results as shown in the following Table 6.

TABLE 6 (a)

| Steel | Mechanical properties Y.S. (kgf/mm²) | T.S. (kgf/mm²) | El (%) | Y.El (%) | A.I. (kgf/mm²) | $\bar{r}$ value | $\Delta\bar{r}$ | Enameling properties P.E.I. adhesion property (%) | Fish-scale | Time causing blistering and pinhole defects (minutes) | weldability | Remarks |
|---|---|---|---|---|---|---|---|---|---|---|---|---|
| 1 | 15 | 31 | 48 | 0 | 0 | 2.1 | 0.2 | 100 | 0/3 | 30 | ○ | Acceptable example |
| 2 | 16 | 32 | 46 | 0 | 0 | 2.0 | 0.4 | 100 | 0/3 | 30 | ○ | Acceptable example |
| 3 | 14 | 30 | 50 | 0 | 0 | 2.2 | 0.3 | 100 | 0/3 | 30 | ○ | Acceptable example |
| 4 | 15 | 31 | 47 | 0 | 0 | 1.8 | 0.2 | 100 | 0/3 | 30 | ○ | Acceptable example |
| 5 | 22 | 35 | 40 | 2 | 3.0 | 1.2 | 0.8 | 100 | 0/3 | 10 | ○ | Comparative example |
| 6 | 16 | 30 | 49 | 0 | 0 | 2.2 | 0.4 | 100 | 0/3 | 30 | ○ | Acceptable example |
| 7 | 15 | 29 | 52 | 0 | 0 | 1.9 | 0.2 | 100 | 0/3 | 30 | ○ | Acceptable example |
| 8 | 21 | 33 | 43 | 2 | 3.0 | 1.3 | 0.5 | 100 | 0/3 | 25 | ○ | Comparative example |
| 9 | 17 | 32 | 43 | 0 | 0 | 1.1 | 1.0 | 100 | 0/3 | 30 | ○ | Comparative example |
| 10 | 16 | 30 | 47 | 0 | 0 | 1.3 | 0.3 | 100 | 0/3 | 30 | ○ | Comparative example |
| 11 | 17 | 32 | 44 | 2 | 2.0 | 1.3 | 0.7 | 100 | 0/3 | 25 | ○ | Comparative example |
| 12 | 20 | 35 | 40 | 1 | 2.4 | 1.2 | 1.1 | 70 | 0/3 | 5 | ○ | Comparative example |
| 13 | 21 | 33 | 45 | 1 | 2.2 | 1.1 | 1.3 | 100 | 3/3 | 20 | ○ | Comparative example |

TABLE 6 (b)

| Steel | Mechanical properties: Y.S. (kgf/mm²) | T.S. (kgf/mm²) | El (%) | Y.El (%) | A.I. (kgf/mm²) | r̄ value | Δr̄ | Enameling properties: P.E.I. adhesion property (%) | Fish-scale | Time causing blistering and pinhole defects (minutes) | weld-ability | Remarks |
|---|---|---|---|---|---|---|---|---|---|---|---|---|
| 14 | 22 | 35 | 42 | 3 | 3.5 | 1.2 | 0.9 | 100 | 3/3 | 25 | ○ | Comparative example |
| 15 | 17 | 32 | 46 | 1 | 2.2 | 1.3 | 0.7 | 100 | 2/3 | 5 | ○ | Comparative example |
| 16 | 18 | 33 | 40 | 1 | 2.7 | 1.2 | 0.6 | 100 | 2/3 | 20 | ○ | Comparative example |
| 17 | 21 | 35 | 39 | 1 | 2.5 | 1.1 | 0.8 | 80 | 0/3 | 10 | ○ | Comparative example |
| 18 | 17 | 30 | 50 | 2 | 3.2 | 1.7 | 0.3 | 100 | 0/3 | 30 | ◎ | Conventional example |
| 19 | 18 | 33 | 45 | 3 | 3.6 | 1.3 | 0.9 | 100 | 0/3 | 25 | ○ | Conventional example |
| 20 | 16 | 31 | 49 | 0 | 2.1 | 1.7 | 0.3 | 100 | 0/3 | 30 | ○ | Acceptable example |
| 21 | 14 | 30 | 50 | 0 | 2.4 | 1.7 | 0.4 | 100 | 0/3 | 30 | ○ | Acceptable example |
| 22 | 14 | 31 | 53 | 0 | 1.0 | 2.4 | 0 | 85 | 0/3 | 40 | ○ | Acceptable example |
| 23 | 15 | 31 | 50 | 0 | 1.0 | 2.2 | 0.1 | 50 | 0/3 | 40 | ○ | Comparative example |
| 24 | 20 | 35 | 44 | 2 | 3.9 | 1.3 | 0.6 | 100 | 0/3 | 25 | ○ | Comparative example |
| 25 | 16 | 31 | 48 | 0 | 1.5 | 1.8 | 0.2 | 100 | 0/3 | 35 | ○ | Acceptable example |
| 26 | 15 | 30 | 50 | 0 | 1.0 | 1.9 | 0.1 | 100 | 0/3 | 30 | ○ | Acceptable example |

TABLE 6 (c)

| Steel | Mechanical properties: Y.S. (kgf/mm²) | T.S. (kgf/mm²) | El (%) | Y.El (%) | A.I. (kgf/mm²) | r̄ value | Δr̄ | Enameling properties: P.E.I. adhesion property (%) | Fish-scale | Time causing blistering and pinhole defects (minutes) | weld-ability | Remarks |
|---|---|---|---|---|---|---|---|---|---|---|---|---|
| 27 | 18 | 33 | 48 | 0 | 1.0 | 1.8 | 0.2 | 100 | 0/3 | 40 | ○ | Acceptable example |
| 28 | 16 | 31 | 50 | 0 | 0 | 2.2 | 0.3 | 100 | 0/3 | 30 | ◎ | Acceptable example |
| 29 | 14 | 29 | 52 | 0 | 0.5 | 2.0 | 0 | 100 | 0/3 | 30 | ○ | Acceptable example |
| 30 | 17 | 31 | 50 | 0 | 0 | 2.1 | 0 | 100 | 0/3 | 40 | ○ | Acceptable example |
| 31 | 16 | 30 | 54 | 0 | 0 | 2.5 | 0 | 100 | 0/3 | 30 | ◎ | Acceptable example |
| 32 | 18 | 33 | 52 | 0 | 0 | 2.2 | 0 | 100 | 0/3 | 30 | ○ | Acceptable example |
| 33 | 15 | 30 | 51 | 0 | 0 | 2.4 | 0.3 | 100 | 0/3 | 35 | ○ | Acceptable example |
| 34 | 18 | 32 | 50 | 0 | 0 | 2.5 | 0 | 100 | 0/3 | 40 | ○ | Acceptable example |
| 35 | 17 | 31 | 52 | 0 | 0 | 2.5 | 0 | 100 | 0/3 | 40 | ○ | Acceptable example |
| 36 | 16 | 31 | 50 | 0 | 0 | 2.1 | 0 | 90 | 0/3 | 35 | ◎ | Acceptable example |
| 37 | 14 | 29 | 55 | 0 | 0 | 2.4 | 0 | 100 | 0/3 | 40 | ◎ | Acceptable example |
| 38 | 14 | 30 | 48 | 0 | 2.0 | 1.7 | 0.6 | 90 | 1/3 | 15 | ○ | Comparative example |

As to the mechanical properties, the steel sheet after the annealing was worked into a tensile test specimen of JIS No. 5 and then the yield points (Y.S.), tensile strengths (T.S.), elongations (El), yield elongations (Y.El) and r̄-values (Lankford value) in directions of 0°, 45° and 90° with respect to the rolling direction were measured, Each of these values was evaluated as an average value by the following equation:

$$X=(X_{0°}+2\times X_{45°}+X_{90°})/4$$

Furthermore, the anisotropy of r̄-value represented by $\Delta r=(r_{0°}-2\times r_{45°}+r_{90°})/2$ and the aging index (A.I.) (stress after the aging at a preliminary strain of 7.5% and 100° C. for 30 minutes — stress at a preliminary strain of 7.5%) are also shown in Table 6.

As to the enameling properties, the tendency of generating the blistering and pinhole defects (large, middle, small or absence) was visually observed with respect to the steel sheet after the enameling, and then the resistance to blistering and pinhole defects was evaluated by a pickling time exhibiting the middle or large.

Further, the enamel adhesion property was measured according to PEI adhesion test (ASTM C313-59).

The fishscale resistance was evaluated by subjecting each of the same three steel sheets to a pretreatment for a pickling time of 20 seconds without Ni immersion, glazing with a commercially available base glaze, drying, firing in a firing furnace having a dew point of 40° C. at 850° C. for 3 minutes and conducting a treatment for acceleration of fishscale occurrence (160° C., 16 hours) to observe the number of sheets generating fishscale. (For example, when the number of sheets generating fishscale is zero, it is represented by 0/3.)

As to the weldability, the blowhole defect and the degree of the shrinkage were visually observed, wherein mark ◎ was no occurrence, mark ○ was slight occurrences and mark x was many occurrence.

As seen from Table 6, the cold rolled steel sheets for porcelain enameling having the chemical composition defined in the invention and produced under the conditions defined in the invention (steels 1-4, 6, 7, 20-22, 25-37) have the press formability and enameling properties (fishscale resistance, resistance to blistering and pinhole defects, enamel adhesion property and the like) equal to or more than those of the conventional decarburization capped steel shown by steel 18. On the other hand, in steel 12, the P amount is outside the range of the invention, so that the blistering and pinhole defects are caused at a pickling time of 5 minutes. In steel 17, the Mn amount is outside the range of the invention, so that the pickling weight reduction becomes large and the blistering and pinhole defects are caused at a pickling time of about 10 minutes. In steel 9, since the annealing temperature is too low, the r̄-value becomes low. In steels 5, 8, 11, 19 and 24, the C amount is outside the range of the invention, the mechanical properties are degraded. Further, in steels 5 and 10, the cold rolling reduction is less than 70%, so that the r̄-value is considerably poor. In steels 13-16 and 38, the amounts of nitrogen, oxygen and boron are less, so that the fishscale defect is caused. In steel 15, the Cu amount is less than 0.001%, so that the scab amount is large and the blistering and pinhole defects are caused by the pickling in a short time. In steel 23, the Cu amount exceeds the upper limit of the invention, so that the enamel adhesion property is considerably poor.

As mentioned above, the B-added steel sheets for porcelain enameling according to the invention have a deep drawability equal to or more than those of the conventional decarburization capped steel and the Ti-added steel having a good press formability and satisfy all of fishscale resistance, enamel adhesion property and surface properties required as a steel sheet for porcelain enameling. Particularly, according to the invention, the occurrence of blistering and pinhole defects being a serious problem in the Ti-added steel is prevented, so that the surface properties more than those of the decarburization capped steel can be ensured even in the production according to the continuous casting method.

Furthermore, high-grade steel sheets for porcelain enameling, which have hitherto been produced by the ingot-making method as in the decarburization capped steel, can be produced by the continuous casting method, so that the invention has great merits in view of the cost and energy-saving.

What is claimed is:

1. A steel sheet for porcelain enameling having improved fishscale resistance and press formability, consisting essentially of not more than 0.0025 wt% of C, not more than 0.50 wt% of Mn, 0.007–0.020 wt% of B, 0.01–0.07 wt% of Cu, not more than 0.010 wt% of Al, 0.008–0.020 wt% of O, 0.005–0.020 wt% of N, not more than 0.020 wt% of P, and the balance being Fe and inevitable impurities.

2. A steel sheet for porcelain enameling having improved fishscale resistance and pressformability, consisting essentially of not more than 0.0050 wt% of C, not more than 0.50 wt% of Mn, 0.007–0.020 wt% of B, 0.01–0.07 wt% of Cu, not more than 0.010 wt% of Al, 0.008–0.020 wt% of O, 0.005–0.020 wt% of N, not more than 0.020 wt% of P, at least one of not more than 0.050 wt% of Ti and not more than 0.050 wt% of Nb provided that a total amount of Ti and Nb is 0.001–0.050 wt%, and the balance being Fe and inevitable impurities.

3. The steel sheet according to claim 1, wherein said steel further contains 0.0001–0.100 wt% of Se.

4. The steel sheet according to claim 2, wherein said steel further contains 0.0001–0.100 wt% of Se.

5. The steel sheet defined in claim 4 wherein said steel sheet contains at least 0.001 wt% and not more than 0.010 wt% of Al.

6. The steel sheet defined in claim 1 wherein said steel sheet contains at least 0.001 wt% and not more than 0.010 wt% of Al.

7. The steel sheet defined in claim 2 wherein said steel sheet contains at least 0.001 wt% and not more than 0.010 wt% of Al.

* * * * *